US009497554B2

(12) United States Patent
Bergner

(10) Patent No.: US 9,497,554 B2
(45) Date of Patent: Nov. 15, 2016

(54) FLEX-BASED CONNECTOR FOR HEARING AID

(71) Applicant: Starkey Laboratories, Inc., Eden Prairie, MN (US)

(72) Inventor: Thomas Blaise Bergner, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 66 days.

(21) Appl. No.: 14/272,135

(22) Filed: May 7, 2014

(65) Prior Publication Data

US 2015/0326981 A1 Nov. 12, 2015

(51) Int. Cl.

| | |
|---|---|
| ***H04R 25/00*** | (2006.01) |
| *H01R 29/00* | (2006.01) |
| *H01R 12/71* | (2011.01) |
| *H01R 12/78* | (2011.01) |
| *H01R 107/00* | (2006.01) |

(52) U.S. Cl.

CPC ..... *H04R 25/556* (2013.01); *H04R 25/00* (2013.01); *H01R 12/714* (2013.01); *H01R 12/78* (2013.01); *H01R 29/00* (2013.01); *H01R 2107/00* (2013.01); *H01R 2201/12* (2013.01)

(58) Field of Classification Search

CPC . H04R 25/556; H04R 2420/09; H01R 12/78
See application file for complete search history.

(56) References Cited

U.S. PATENT DOCUMENTS

| | | | | |
|---|---|---|---|---|
| 4,961,230 | A * | 10/1990 | Rising | H04R 25/556 381/322 |
| 5,404,407 | A * | 4/1995 | Weiss | H04R 25/502 381/23.1 |
| 5,502,769 | A * | 3/1996 | Gilbertson | H04R 25/556 381/309 |
| 5,799,095 | A * | 8/1998 | Hanright | H04R 25/556 381/312 |
| 6,044,164 | A * | 3/2000 | Ach-Kowalewski | H04R 25/505 381/312 |
| 6,678,386 | B2 * | 1/2004 | Robinson | H04R 25/556 381/314 |
| 6,733,319 | B1 * | 5/2004 | Jørgensen | H01R 4/48 439/329 |
| 6,981,887 | B1 | 1/2006 | Mese et al. | |
| 6,985,598 | B1 * | 1/2006 | Joschika | H04R 25/556 381/312 |
| 2004/0052390 | A1 * | 3/2004 | Morales | H04R 25/556 381/323 |
| 2009/0129614 | A1 * | 5/2009 | Buttner | H04R 25/556 381/314 |
| 2011/0002493 | A1 * | 1/2011 | Campbell | H04R 25/65 381/330 |

(Continued)

FOREIGN PATENT DOCUMENTS

| | | | |
|---|---|---|---|
| CH | 673551 | A5 | 3/1990 |
| WO | WO-9844761 | A2 | 10/1998 |
| WO | WO-2011150403 | A1 | 12/2011 |

OTHER PUBLICATIONS

European Application Serial No. 15166697.1, Extended European Search Report mailed Sep. 8, 2015, 8 pgs.

*Primary Examiner* — Matthew Eason

(74) *Attorney, Agent, or Firm* — Schwegman Lundberg & Woessner, P.A.

(57) ABSTRACT

Described herein is a multi-pin flex-based electrical plug and socket that can be incorporated into a hearing aid and be used to serve two purposes depending on the orientation with which the plug is inserted into the socket. For example, the plug may be inserted into the socket in a first orientation (e.g., right-side up) for programming the hearing aid and inserted in a second orientation (e.g., upside down) for inputting a DAI signal. In an alternate embodiment, the plug and socket forms a both-ways-okay connector such that the plug can be inserted in a either a first orientation or a second orientation (e.g., either right-side up or upside down) and still function.

17 Claims, 5 Drawing Sheets

(56) References Cited

U.S. PATENT DOCUMENTS

2013/0216077 A1* 8/2013 Tipsmark ..... H04R 25/556 381/314

2014/0153768 A1* 6/2014 Hagen ..... H04R 1/1008 381/380

2015/0230035 A1* 8/2015 Prchal ..... H04R 25/608 381/323

* cited by examiner

FLEX-BASED CONNECTOR FOR HEARING AID

FIELD OF THE INVENTION

This invention pertains to electronic hearing aids and methods for their use.

BACKGROUND

Electrical connectors for data transfer in electronic devices tend to be large and bulky. In some electronic devices, more than one electrical connector is needed. Hearing aids, for example, are electronic instruments that compensate for hearing losses by amplifying sound and typically may include both a programming connector for configuring operational parameters as well as a secondary connector for Direct Audio Input (DAI). Incorporating multiple connectors for DAI and programming, however, takes up precious space inside the hearing aid and requires numerous different plugs that a hearing aid user would need to keep track of.

DETAILED DESCRIPTION

Described herein is a multi-pin flex-based electrical plug and socket that can be incorporated into a hearing aid and be used to serve two purposes depending on the orientation with which the plug is inserted into the socket. For example, the plug may be inserted into the socket in a first orientation (e.g., right-side up) for programming the hearing aid and inserted in a second orientation (e.g., upside down) for inputting a DAI signal. Two different connectors can then be replaced with one orientable dual-purpose plug and socket. The socket may be made up of a flex circuit wrapped around a structural housing or frame. The connection between the flex-based plug and the flex-based socket may be accomplished by exposed pads on each part coming into contact with each other. To ensure a reliable connection is made between the plug and socket, one set of exposed pads may incoroprate sculpted flex bumps. A spring feature may be included to increase the contact force of the electrical connection. In an alternate embodiment, the plug and socket forms a both-ways-okay connector such that the plug can be inserted in a either a first orientation or a second orientation (e.g., either right-side up or upside down) and still function. The functionality of the flex-based connector is described below primarily with reference to its incorporation in a hearing aid. It should be appreciated, however, that the flex-based connector, in either the dual-purpose or both-ways-okay embodiment, may be similarly used in any type of electronic device.

Hearing Aid Components

Figure 1:
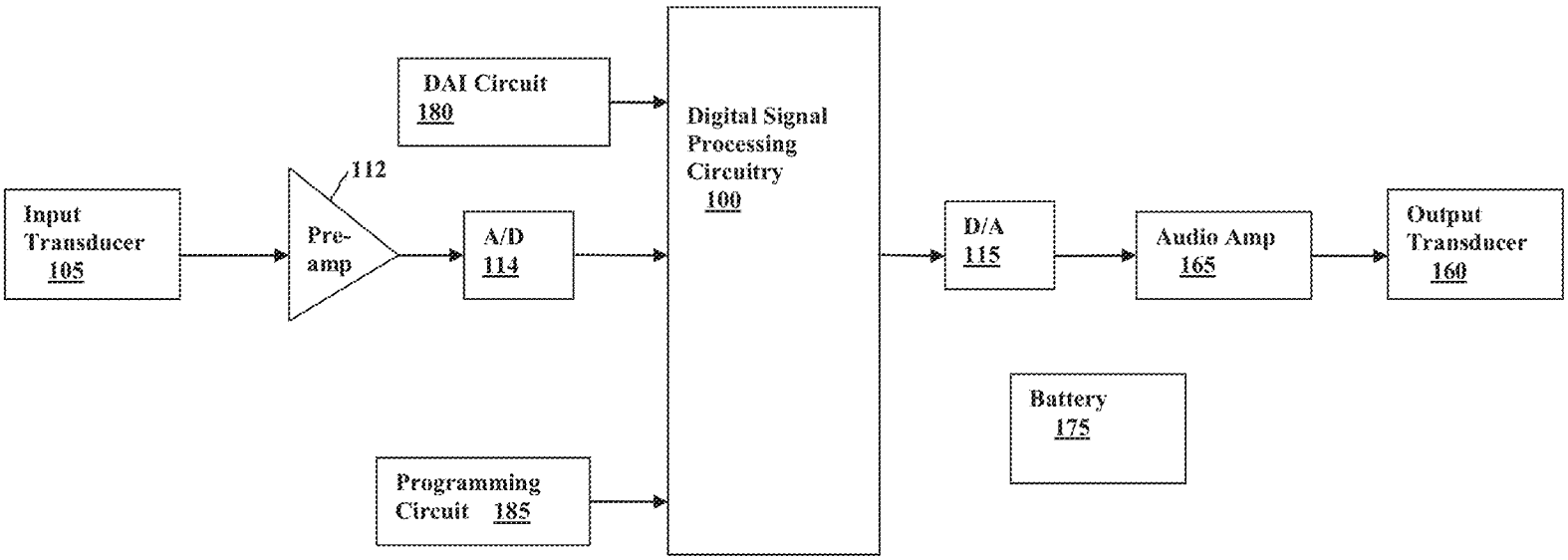
FIG. 1 shows the basic electronic components of an example hearing aid.

FIG. 1 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. A microphone 105 receives sound waves from the environment and converts the sound into an input signal. After amplification by pre-amplifier 112, the input signal is sampled and digitized by A/D converter 114 to result in a digitized input signal. The device's digital signal processor (DSP) circuitry 100 processes the digitized input signal into an output signal in a manner that compensates for the patient's hearing deficit. The output signal is then converted to analog form by D/A converter 115 and passed to an audio amplifier 165 that drives the receiver or speaker 160 to convert the output signal into an audio output. A battery 175 supplies power for the electronic components.

The DSP circuitry 100 may be implemented in a variety of different ways, such as with an integrated digital signal processor or controller or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

In order to configure the operational behavior of the hearing aid, a programming circuit 185 is provided to pass programming signals to the DSP 100. Also shown in FIG. 1 is a DAI circuit 180 for receiving a DAI signal. The DSP may then use the DAI signal to generate the audio output signal or may combine the DAI signal with the microphone input signal to generate audio for the user.

Flex-Based Connector

Figure 2:
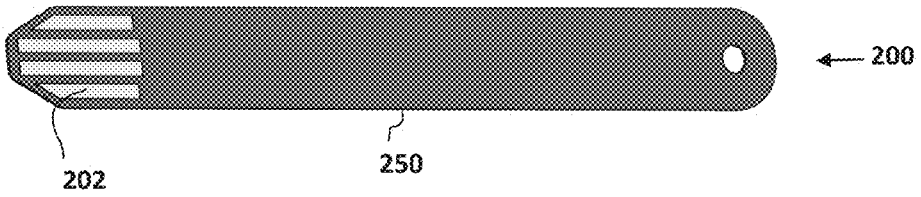
FIG. 2 shows an example of a plug connector.

FIG. 2 illustrates an example embodiment of a connector plug 200. The connector plug 200 may be an elongated planar member 250 having one or more plug pads 202 at one end and on one side. Four such plug pads 202 are shown in the figure. The plug pads 202 may be electrically connected by traces within the plug to terminals of a peripheral device such as a hearing aid programmer or a DAI source. The connector plug 200 may be a flex-based structure made of a flexible polymeric base material.

Figure 3A:
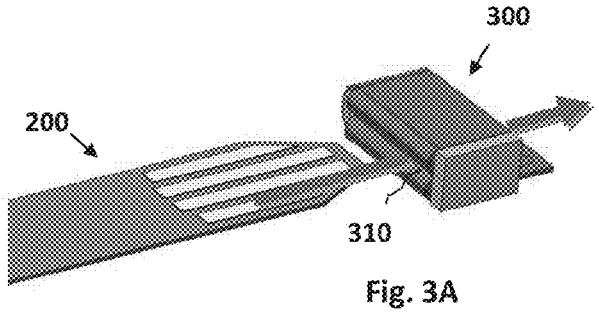
FIGS. 3A and 3B show the insertion of a plug connector into a socket.
Figure 3B:
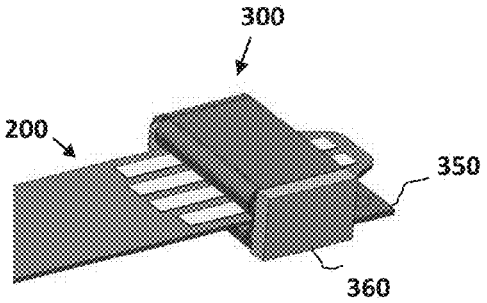

FIGS. 3A and 3B illustrate the insertion of the connector plug 200 into a socket 300 that may, for example, be mounted into a hearing aid and electrically connected to the hearing aid circuitry. FIG. 3A shows the connector plug 200 being positioned for insertion into a slot 310 of the socket. FIG. 3B shows the connector plug 200 inserted into the slot 310 where, as described below, the plug pads 202 make contact with corresponding socket pads 302 within the slot 310.

Figure 4:
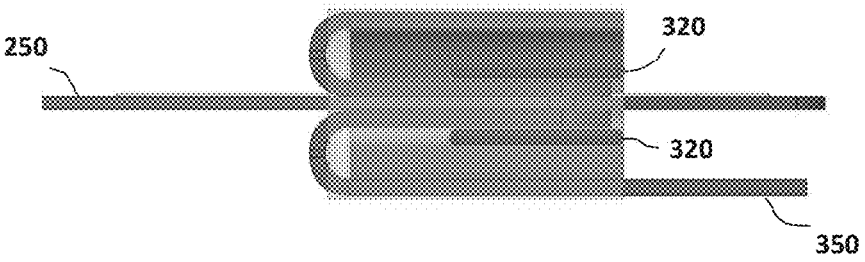
FIG. 4 is a cross-sectional view of a plug connector inserted into a socket.

FIG. 4 shows a cross-sectional view of the connector plug 200 inserted into the slot 310 of the socket 300. As described in more detail below, the socket 300 may comprise a flex circuit, referred to as socket flex 350, wrapped around a frame structure 360. The socket 300 may incorporate contact force elastomeric springs 320 interposed between the socket frame 360 and socket flex 350 so as to force the walls of the slot 310 against the connector plug 200 and provide a more secure connection between socket pads 302 and plug pads 202.

Figure 5:
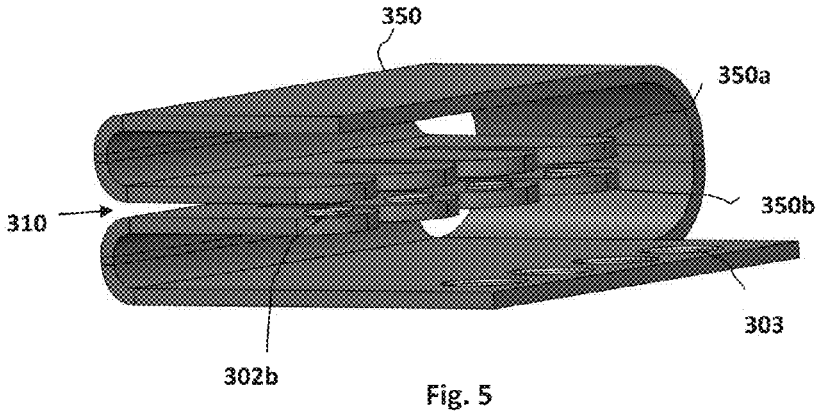
FIG. 5 is a perspective view of the socket flex formed into a socket.

FIG. 5 shows a folded socket flex 350 where slot 310 is formed by upper wall 350*a* and lower wall 350*b* of the socket flex. Four socket pads 302*b* are shown on lower wall 350*b* with four socket pads 302*a* (not shown in the figure) on upper wall 350*a* in opposition thereto. The socket pads 302*a* and 302*b* may be sculpted flex contact bumps. Four solder pads 303 are disposed on an edge portion of the socket flex 350. As described below, traces in the socket flex electrically connect the socket pads 302*a/b* to the solder pads 303. The solder pads 303 are designed to be electrically connected to terminals within a device such as a hearing aid (e.g., to the programming circuit and/or DAI circuit).

Figure 6:
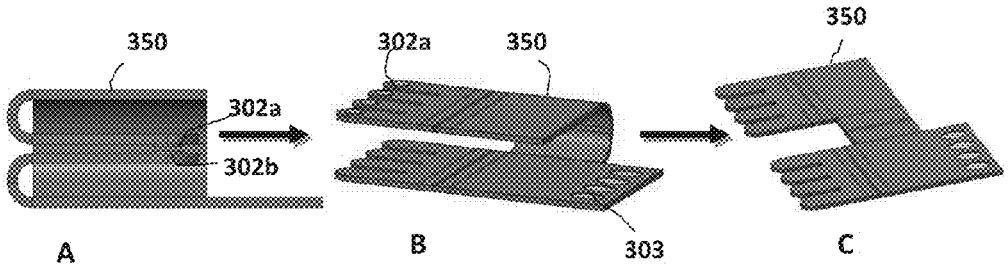
FIG. 6 illustrates the unfolding of a socket into a flat planar socket flex.

The socket flex 350 may be a planar flex-based structure that is folded to form a slot into which the plug connector is inserted. FIG. 6 shows stages A through C of a socket flex 350 being unfolded from a socket structure A to a flat planar structure C. Construction of the socket 300 would involve disposing the socket pads 302*a/b* and the solder pads 303 on the flat planar structure C, connecting the pads via traces, and performing the reverse process of folding the socket flex 350 from a flat planar structure C to a socket structure A.

Figure 7:
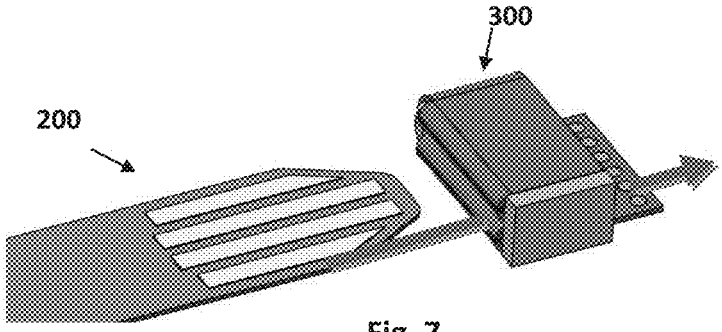
FIG. 7 shows the insertion of the plug connector into the socket in a first orientation.
Figure 8:
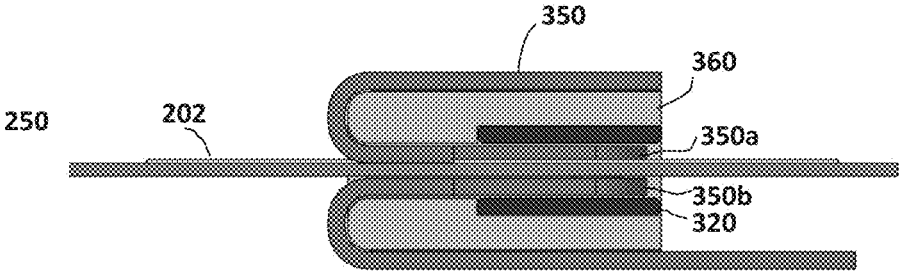
FIG. 8 is a cross-sectional view of the plug connector inserted into the socket in a first orientation.
Figure 9:
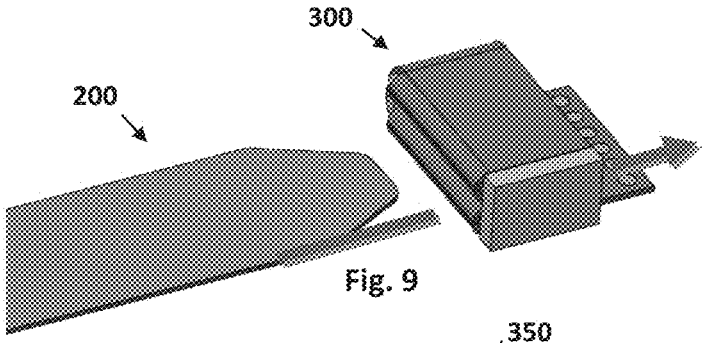
FIG. 9 shows the insertion of the plug connector into the socket in a second orientation.
Figure 10:
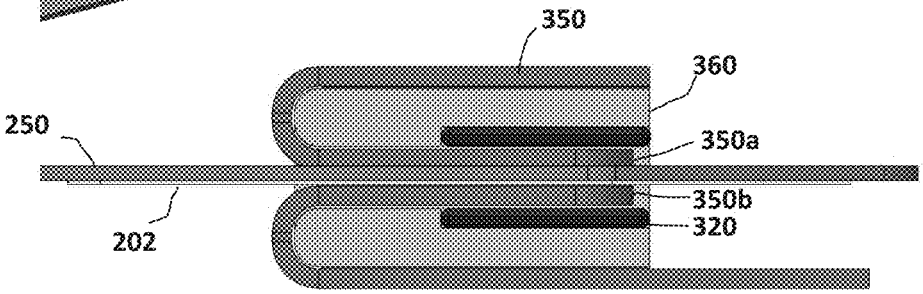
FIG. 10 is a cross-sectional view of the plug connector inserted into the socket in a second orientation.

FIG. 7 shows the plug connector 200 being inserted into socket 300 in a first orientation, shown as right-side up. In this orientation, the plug pads 202 make contact with the socket pads in the upper wall 350*a* of the socket as shown in FIG. 8, shown as socket pads 302*a* in FIG. 6. FIG. 9 shows the plug connector 200 being inserted into socket 300 in a second orientation, shown as upside down. In this orientation, the plug pads 202 make contact with the socket pads in the lower wall 350*b* of the socket as shown in FIG. 10, shown as socket pads 302*b* in FIG. 6.

Figure 11:
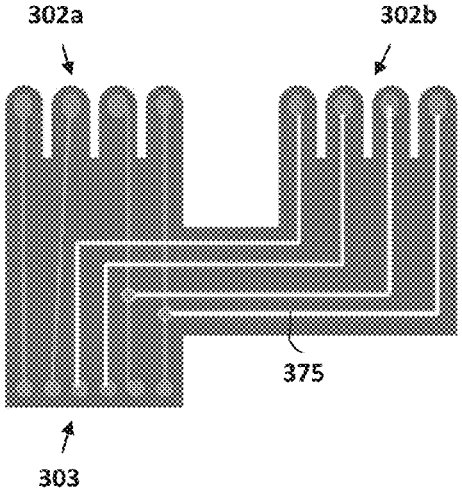
FIG. 11 illustrates the trace connections between the socket pads and the solder pads of the socket flex in a dual-function embodiment of the flex connector.

In one embodiment, inserting the plug connector 200 into the socket 300 with different orientations changes the functionality of the connector. In this embodiment, as shown in the example of FIG. 11, the trace connections 375 between the solder pads 303 and the socket pads 302*a* are different from the trace connections between the solder pads 303 and the socket pads 302*b*. By connecting the solder pads 303 to appropriate terminals of the peripheral device in which the socket 300 is mounted, the socket 300 may be made to serve different functions depending upon how the plug connector 200 is inserted. In a hearing aid, for example, one orientation of the plug connector may be used for DAI, while the other orientation may be used for programming.

Figure 12:
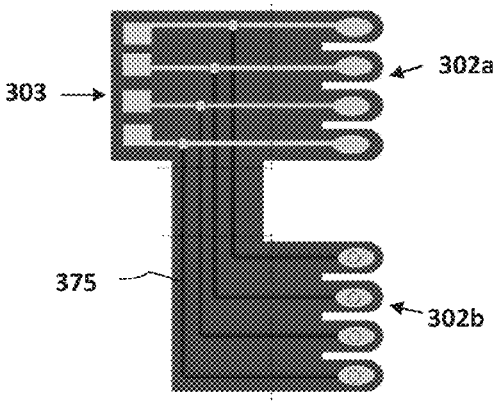
FIG. 12 illustrates the trace connections between the socket pads and the solder pads of the socket flex in a both-ways-okay embodiment of the flex connector.

In another embodiment, as shown in the example of FIG. 12, the trace connections 375 between the solder pads 303 and the socket pads 302*a* are the same as the trace connections between the solder pads 303 and the socket pads 302*b*. In this embodiment, the plug connector 200 may be inserted into the socket 300 upside down or right-side up and still function.

Example Embodiments

In one embodiment, a flex-based connector comprises: a socket for receiving a connector plug, wherein the connector plug has one or more plug pads that make contact with one or more socket pads of the socket when the connector plug is inserted, wherein the connector plug is a flex-based planar structure having first and second surfaces and having the plug pads on only the first surface, and wherein the socket is constructed by folding a flex-based socket planar structure having multiple edges. The locations of the plug pads and the socket pads may be such that the one or more plug pads are electrically connected to a user input circuit when the connector plug is inserted into the socket in a first orientation and such that one or more plug pads are electrically connected to the user input circuit when the connector plug is inserted into the socket in a second orientation rotated 180 degrees relative to the first orientation. Alternatively, the locations of the plug pads and the socket pads may such that the one or more plug pads are electrically connected to a first input circuit when the connector plug is inserted into the socket in a first orientation and such that one or more plug pads are electrically connected to a second input circuit when the connector plug is inserted into the socket in a second orientation.

In another embodiment, a hearing aid comprises: a microphone for converting an audio input into an input signal; a direct audio input (DAI) circuit for receiving a DAI signal; a digital signal processor (DSP) for processing the input signal, the DAI signal, or a combination thereof into an output signal in a manner that compensates for a patient's hearing deficit; an audio amplifier and speaker for converting the output signal into an audio output; a programming circuit for receiving programming signals to configure the DSP; a socket for receiving a connector plug, wherein the connector plug has one or more plug pads that make contact with one or more socket pads of the socket when the connector plug is inserted; and, wherein the locations of the plug pads and the socket pads are such that the one or more plug pads are electrically connected to the DAI circuit when the connector plug is inserted into the socket in a first orientation and such that one or more plug pads are electrically connected to the programming circuit when the connector plug is inserted into the socket in a second orientation. The first orientation of the connector plug may be 180 degrees rotated relative to the second orientation. The connector plug may be a planar structure or flex-based planar structure having first and second surfaces and having the plug pads on only the first surface. The socket may be a slot into which the connector plug is inserted, wherein the slot includes a first surface with socket pads thereon that are electrically connected to the programming circuit and a second surface with socket pads thereon that are electrically connected to the DAI circuit. The socket may be constructed by folding a flex-based socket planar structure having multiple edges, wherein the socket planar structure includes: a first set of one or more socket pads near a first edge, a second set of socket pads near a second edge, and a set of solder pads near a third edge; traces that electrically connect each of the solder pads to one or more members of the first and second sets of socket pads; wherein each of the set of solder pads are electrically connected to one or more terminals belonging to one or both of the programming circuit and the DAI circuit; and wherein, when the socket planar structure is folded to form the slot, the first and second set of contact pads are situated on opposite sides of the slot. The socket pads and/or plug pads may be sculpted flex bumps. The socket may further comprise a spring that forces the socket pads against the plug pads, and the spring may be an elastomeric material.

In another embodiment, a hearing aid, comprises: a microphone for converting an audio input into an input signal; a digital signal processor (DSP) for processing the input signal, into an output signal in a manner that compensates for a patient's hearing deficit; an audio amplifier and speaker for converting the output signal into an audio output; a socket for receiving a connector plug, wherein the connector plug has one or more plug pads that make contact with one or more socket pads of the socket when the connector plug is inserted; and, wherein the locations of the plug pads and the socket pads are such that the one or more plug pads are electrically connected to a user input circuit when the connector plug is inserted into the socket in a first orientation and such that one or more plug pads are electrically connected to the user input circuit when the connector plug is inserted into the socket in a second orientation rotated 180 degrees relative to the first orientation. The user input circuit may a programming circuit for receiving programming signals to configure the DSP or a direct audio input (DAI) circuit for receiving a DAI signal. The connector plug may a planar structure or flex-based planar structure having first and second surfaces and having the plug pads on only the first surface. The socket may a slot into which the connector plug is inserted, wherein the slot includes a first surface with socket pads thereon that are electrically connected to the user input circuit and a second surface with socket pads thereon that are electrically connected to the user input circuit. The socket may be constructed by folding a flex-based socket planar structure having multiple edges, wherein the socket planar structure includes: a first set of one or more socket pads near a first edge, a second set of socket pads near a second edge, and a set of solder pads near a third edge; traces that electrically connect each of the solder pads to one or more members of the first and second sets of socket pads; wherein each of the set of solder pads are electrically connected to one or more terminals belonging to the user input circuit; and wherein, when the socket planar structure is folded to form the slot, the first and second set of contact pads are situated on opposite sides of the slot. The socket pads and/or plug pads may be sculpted flex bumps. The socket may further comprise a spring that forces the socket pads against the plug pads, and the spring may be an elastomeric material.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A hearing aid, comprising:

a microphone for converting an audio input into an input signal;

a direct audio input (DAI) circuit for receiving a DAI signal;

a digital signal processor (DSP) for processing the input signal, the DAI signal, or a combination thereof into an output signal in a manner that compensates for a patient's hearing deficit;

an audio amplifier and speaker for converting the output signal into an audio output;

a programming circuit for receiving programming signals to configure the DSP;

a socket for receiving a connector plug, wherein the connector plug has one or more plug pads that make contact with one or more socket pads of the socket when the connector plug is inserted; and, wherein the locations of the plug pads and the socket pads are such that the one or more plug pads are electrically connected to the DAI circuit when the connector plug is inserted into the socket in a first orientation and such that one or more plug pads are electrically connected to the programming circuit when the connector plug is inserted into the socket in a second orientation.

2. The hearing aid of claim 1 wherein the connector plug is a planar structure having first and second surfaces and having the plug pads on only the first surface.

3. The hearing aid of claim 1 further comprising a connector plug, wherein the connector plug is a flex-based planar structure having first and second surfaces and having the plug pads on only the first surface.

4. The hearing aid of claim 2 wherein the socket is a slot into which the connector plug is inserted, wherein the slot includes a first surface with socket pads thereon that are electrically connected to the programming circuit and a second surface with socket pads thereon that are electrically connected to the DAI circuit.

5. The hearing aid of claim 4 wherein the socket is constructed by folding a flex-based socket planar structure having multiple edges, wherein the socket planar structure includes:

a first set of one or more socket pads near a first edge, a second set of socket pads near a second edge, and a set of solder pads near a third edge;

traces that electrically connect each of the solder pads to one or more members of the first and second sets of socket pads;

wherein each of the set of solder pads are electrically connected to one or more terminals belonging to one or both of the programming circuit and the DAI circuit; and wherein, when the socket planar structure is folded to form the slot, the first and second set of contact pads are situated on opposite sides of the slot.

6. The hearing aid of claim 5 wherein the socket pads are sculpted flex bumps.

7. The hearing aid of claim 5 wherein the plug pads are sculpted flex bumps.

8. The hearing aid of claim 5 wherein the socket further comprises a spring that forces the socket pads against the plug pads.

9. The hearing aid of claim 8 wherein the spring is an elastomeric material.

10. The hearing aid of claim 1 wherein the first orientation of the connector plug is 180 degrees rotated relative to the second orientation.

11. A hearing aid, comprising:

a microphone for converting an audio input into an input signal;

a digital signal processor (DSP) for processing the input signal, into an output signal in a manner that compensates for a patient's hearing deficit;

an audio amplifier and speaker for converting the output signal into an audio output;

a socket for receiving a connector plug, wherein the connector plug has one or more plug pads that make contact with one or more socket pads of the socket when the connector plug is inserted;

wherein the locations of the plug pads and the socket pads are such that the one or more plug pads are electrically connected to a user input circuit when the connector plug is inserted into the socket in a first orientation and such that one or more plug pads are electrically connected to the user input circuit when the connector plug is inserted into the socket in a second orientation rotated 180 degrees relative to the first orientation;

wherein the connector plug is a planar structure having first and second surfaces and having the plug pads on only the first surface;

wherein the socket is a slot into which the connector plug is inserted, wherein the slot includes a first surface with socket pads thereon that are electrically connected to the user input circuit and a second surface with socket pads thereon that are electrically connected to the user input circuit and is constructed by folding a flex-based socket planar structure having multiple edges, wherein the socket planar structure includes:

a first set of one or more socket pads near a first edge, a second set of socket pads near a second edge, and a set of solder pads near a third edge;

traces that electrically connect each of the solder pads to one or more members of the first and second sets of socket pads;

wherein each of the set of solder pads are electrically connected to one or more terminals belonging to the user input circuit; and wherein, when the socket planar structure is folded to form the slot, the first and second set of contact pads are situated on opposite sides of the slot.

12. The hearing aid of claim 11 wherein the user input circuit is a programming circuit for receiving programming signals to configure the DSP.

13. The hearing aid of claim 11 wherein the user input circuit is direct audio input (DAI) circuit for receiving a DAI signal.

14. The hearing aid of claim 11 wherein the connector plug is a flex-based planar structure having first and second surfaces and having the plug pads on only the first surface.

15. The hearing aid of claim 11 wherein the socket pads are sculpted flex bumps.

16. The hearing aid of claim 11 wherein the plug pads are sculpted flex bumps.

17. The hearing aid of claim 11 wherein the socket further comprises a spring that forces the socket pads against the plug pads.

* * * * *